United States Patent [19]

De Vivo et al.

[11] 4,228,557

[45] Oct. 21, 1980

[54] APPARATUS FOR TREATMENT OF THE PERSON

[76] Inventors: Alessandro De Vivo, Via Bardazzi 33, Florence; Gianni Pierantozzi, Via dei Ciliegi 6, Scandicci, Florence; Diodato Santarpia, Via Conti 9, San Miniato Alto, Pisa; Renzo Spolverini, Via Roma 65, Rignano Sull'Arno, Florence, all of Italy

[21] Appl. No.: 37,308

[22] Filed: May 9, 1979

[30] Foreign Application Priority Data

May 19, 1978 [IT] Italy ..... 9469 A/78

[51] Int. Cl.[3] ..... A47K 7/04

[52] U.S. Cl. ..... 15/21 E; 128/56

[58] Field of Search ..... 15/21 R, 21 B, 21 C, 15/21 D, 21 E, 97 R; 128/56, 62 R

[56] References Cited

U.S. PATENT DOCUMENTS

| | | | |
|---|---|---|---|
| 1,609,796 | 12/1926 | Cheney | 128/56 |
| 3,115,322 | 12/1963 | Fleming | 15/21 R X |
| 3,768,462 | 10/1973 | Boulard | 15/21 R |

FOREIGN PATENT DOCUMENTS

| | | | |
|---|---|---|---|
| 2429808 | 1/1976 | Fed. Rep. of Germany | 128/56 |

*Primary Examiner*—Edward L. Roberts

*Attorney, Agent, or Firm*—Hopgood, Calimafde, Kalil, Blaustein & Lieberman

[57] ABSTRACT

An apparatus for personal hygiene is disclosed having a vertically reciprocating brush which is adapted to rotate about its axis. The rotatable brush projects from a housing which is mounted on a wall such that it is possible to bring the body into the path of the brush during its vertical reciprocatory movement. The vertical reciprocating and rotational movement of the brush are provided by a single power source.

5 Claims, 5 Drawing Figures

APPARATUS FOR TREATMENT OF THE PERSON

The invention relates to apparatus for treatment, e.g. washing, of the person which is suitable for installation in bathrooms, shower rooms or similar rooms of this type. It has the aim of providing a convenient way of washing ane even massaging the body, even those regions which cannot easily be reached. The apparatus has as its main object to make it possible to carry out such operations with great ease and comfort as compared with what it is possible to carry out manually.

According to the present invention there is provided apparatus for treatment of the person, which comprises a rotatable brush means, a fitting carrying the brush means, a structure which is attachable to a wall and incorporates an upwardly extending guiding system for the fitting, means for moving the fitting in said guiding system so that in use it can move reciprocatively along said guiding system, and means for rotating the brush means.

By means of the apparatus of the present invention, it is possible for a person using the apparatus to place himself in a position such that the rotating brush means are able to reach various regions of the body extending practically over the whole height of a person, whilst he adopts various orientations with respect to the brush means and uses the latter at will for soaping or rinsing or even for massaging. Conveniently the apparatus is located adjacent a shower for providing running water.

The brush means are replaceable and can be selected at will from a range comprising various types, depending on the particular need; the fitting which slides in a reciprocating manner may consequently be provided with a releasable coupling system for a brush means mounted upon a rotating spindle.

In practice the rotating brush means can be designed and arranged to jut out from the structure constituting the guiding system in order to rotate about a horizontal axis; the manner by which the structure which is fixed to the wall and the extent to which a rotatable fitting of the brush means for carrying out the various brushes project, being selected in such a way that it is possible to bring the body with ease to the point where the brush means is moving in its vertical reciprocating path. The installation can be set up at a point where a shower is located above a shower tray or equivalent fitting, above a bath tub or in any other suitable position. The structure which is attachable to a wall can be made up by an elongated enclosure optionally having compartments for storing the brush or other appliances and having a suitably protected housing and generally includes a guide for the vertical movement of a fitting which is guided in the said housing using roller means or similar; for example, rollers which are at least in part rubberized may advantageously be used: the said housing carrying both the means for controlling the reciprocal motion of the fitting and the means for supplying rotary motion to a spindle body, which, in particular, has a horizontal axis, and passes out from the protective housing through a longitudinal slot in one wall of the said housing, and carries an external coupling for the brush means.

Rotation of the brush means can be achieved by using a splined or polygonal shaft which is parallel to the intended direction of movement of the brush means and is slidably connected with a wheel on the movable fitting, which takes off the rotary motion which is then transmitted to the spindle. In order to provide the reciprocating motion a threaded rod may be provided, with which a female screw rack or similar of the fitting engages: the threaded rod can be used to provide reciprocating motion by changing its direction by means of, for example, suitable limiting switches, or it may rotate continuously, and the reciprocating motion be developed by means, for example of two opposite threads connected together.

Provision may be made for reversing a direction of rotation of the brush means corresponding to the point at which the reciprocating motion of the fittings along the vertical guiding system changes.

The apparatus according to the present invention will be better understood when reference is made to the description and the set of drawings, which show, by way of example only, one preferred embodiment. In the drawings:

FIGS. 1 and 2 respectively show one embodiment of an apparatus according to the invention in perspective view and an enlarged view of a part of the same, all parts being shown diagrammatically for the purpose of aiding comprehension.

Figure 1:
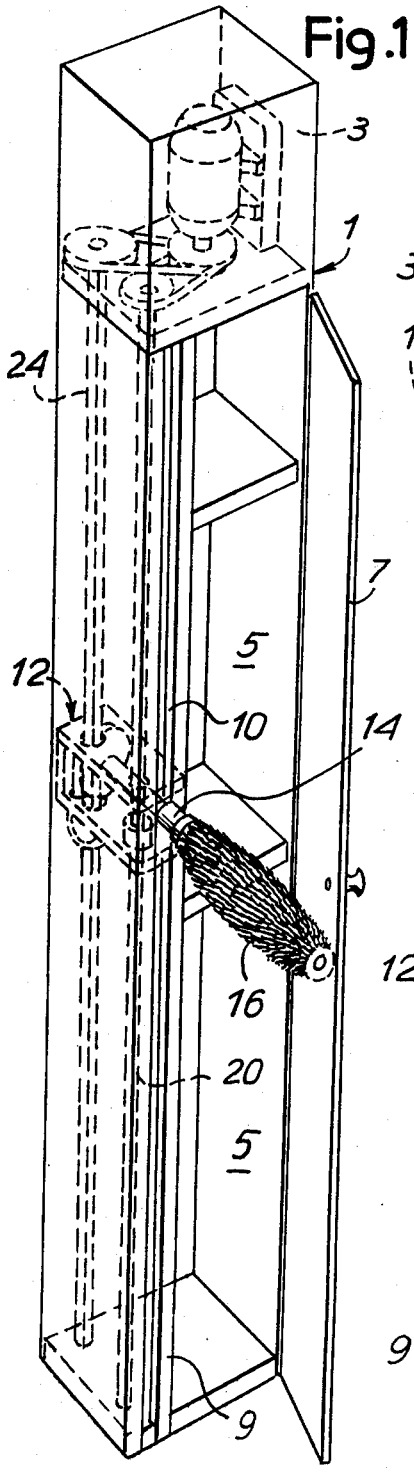
Figure 2:
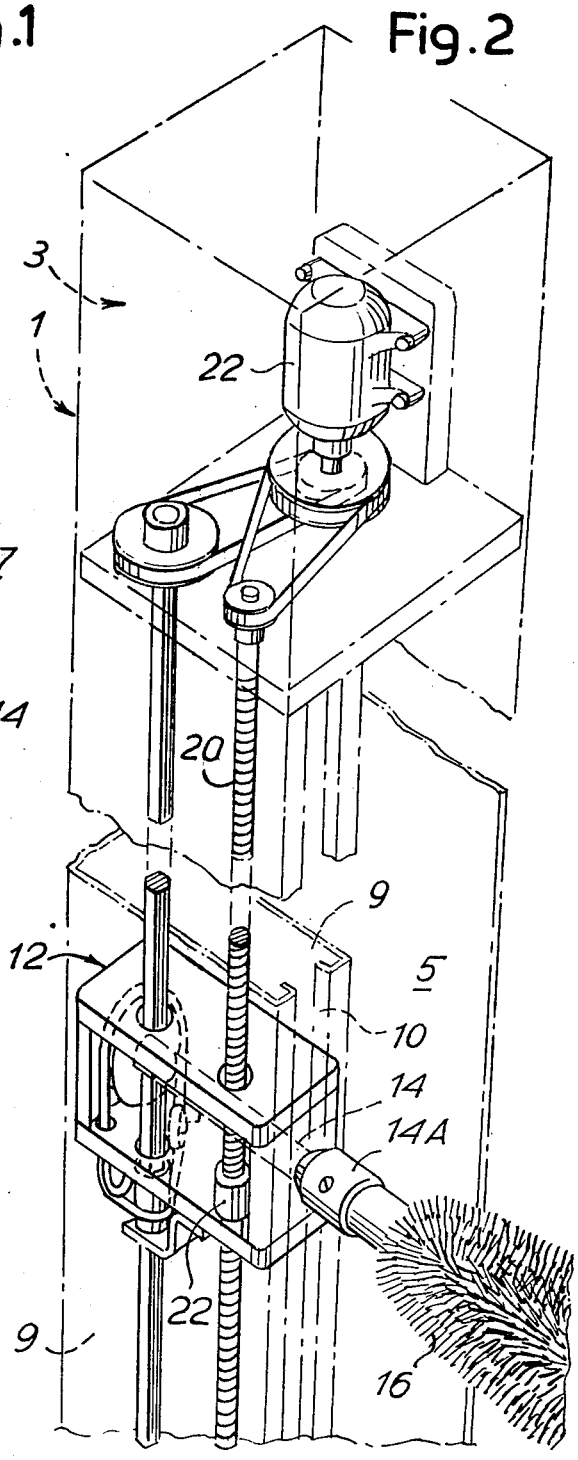
Figure 3:
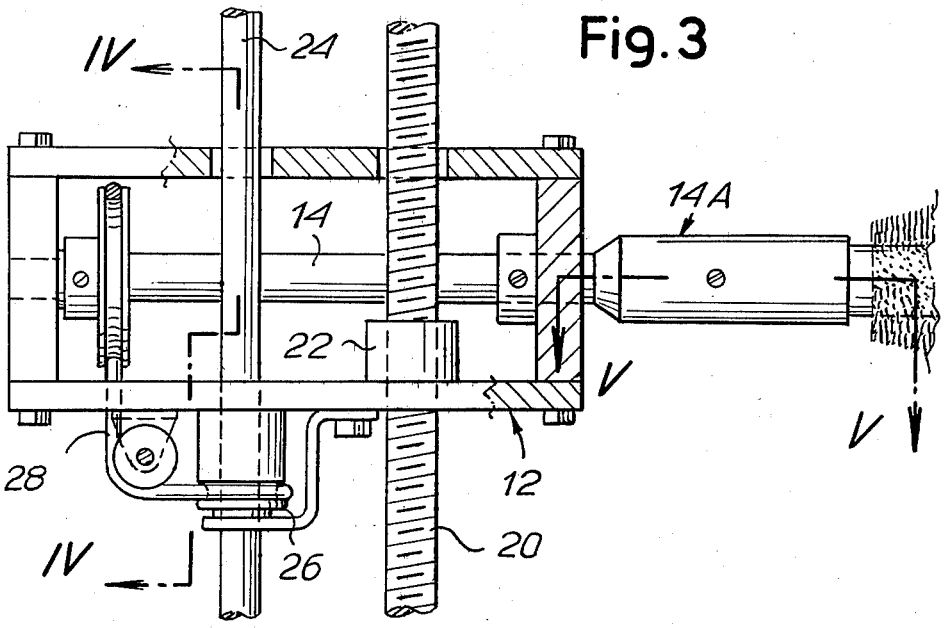
FIG. 3 is a view partly in section of the fitting which moves with a reciprocal motion.
Figure 4:
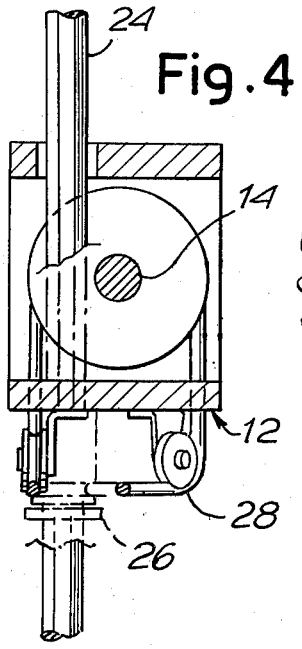
FIGS. 4 and 5 show cross-sectional views along the lines IV—IV and V—V respectively of FIG. 3.

With reference now to what is shown in the attached drawings, 1 indicates an enclosure—having a shape which may be varied to make it aesthetically appealing—which can be made up by a first upper compartment 3 for the motor operating means, and useful compartments 5 which are accessible through a door 7—which pivots at one side, folds away, or similar—which is arranged in the most suitable manner for protecting the inside from spray etc. (and which may consequently provide access at the opposite side to that shown in FIG. 1). At the front of compartments 5 an elongated protective housing 9 is provided which constitutes a vertical guiding system; the inside of the housing 9 is accessible through a longitudinal slot 10, which takes up a vertical position when the whole unit is installed vertically in a bathroom or similar; the slot may be provided with a suitable seal (not shown). The housing 9 receives and guides in the vertical direction and in opposing senses, a movable fitting which is generally indicated by 12. The fitting 12 is designed in any suitable manner and may differ from what has been shown diagrammatically in the drawing. In particular the fitting may carry projecting rollers in order to perform a guiding function against the internal walls of the elongated housing, in particular along the corners or adjacent to the longitudinal corners; these rollers—which are not shown in the drawing—may be at least in part covered with an elastic layer which provides for the adhesion and centering without any particular precision needed in their manufacture.

Figure 5:
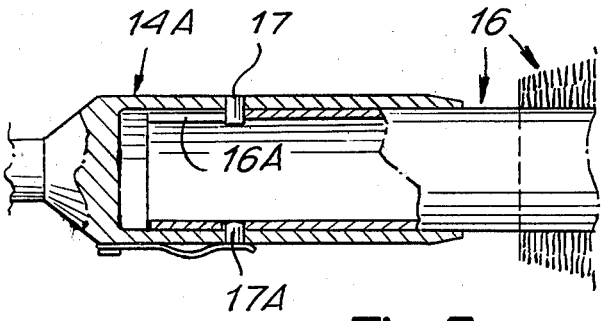

The fitting 12 carries support means for a rotatable body having a horizontal axis, which is generally indicated by 14, and is in the form of a spindle or similar, which projects from the fitting 12 and passes out through the slot 10 where it carries a coupling 14A which is outside the enclosure 1, and external of the slot 10. A brush means 16 can be engaged with the coupling 14; it is also possible to provide a range of substantial appliances having differing characteristics depending on the function which each is to perform and the preferences of the user; the brush appliances can have differing shape, dimensions, bristle characteristics etc; apart from brush appliances it is also possible to use absorbent means, sponge means etc and the term "brush means" is to be understood as embracing all such objects. The brush appliances can be kept in the compartments 5. FIG. 5 shows an example of a coupling with a guide pin 17 engaged in a slot 16A, a resilient retainer 17A being employed.

The brush appliances may for particular purposes be required to be temporarily of the non-rotating type, and in this case the drive arrangement—to be described below—for spindle 14, 14A can be made inactive. Alternatively or additionally it is also possible to provide a clutch coupling (for example using a controllable idler-belt arrangement) for stopping the vertical movement whilst maintaining rotation.

The fitting 12 is displacable vertically along the guiding systems made up by the elongated housing 9, with a reciprocating motion. In order to provide for this a threaded rod 20 mounted on structure 1,9 may be provided which is driven in rotation by a motor 22 for example, the rotation of which can be reversed in order to obtain the rotation in two senses leading to the alternating displacement in two opposing senses of the fitting 12, which latter has a female screw 22 which engages with the screw or threaded rod 20.

In order to provide for rotation of spindle 14, a second shaft or rotating rod 24 can be provided which has a splined outer surface on which a hub 26 fitted with a pulley wheel slides for transmitting the rotation of rod 24 (whilst the fitting 12 is sliding) to spindle 14 using a belt 28 (as shown in the drawings) or using a transmission arrangement employing gear wheels, or alternative but equivalent means.

Suitable end stops may be provided for changing over the sense of rotation of rod 20 and consequently the sense of the vertical movement of fitting 12, by means of which it is also possible, and preferable, to change over the sense of rotation of the brush appliance 16 or equivalent means.

Alternatively a rod with a double thread can be used with a key engaging in its channel for vertical reciprocation; in this case it is possible for the motor to always rotate in the same direction for driving the sliding fitting, and a reversing arrangement can be provided if it is desired to change over the direction of drive of the brush.

FIG. 5 shows a coupling using an elastically mounted retaining pin. This arrangement could be of the snap fit type using a resiliently mounted ball or similar for extraction and insertion.

It is possible to make any variations in the design and practical embodiments of the invention, whilst remaining within the scope of the latter. The drawing only shows one embodiment given by way of a practical demonstration of the invention, the invention providing for variation in design and arrangement without departing from the scope of the basic concept which constitutes the invention as defined by the appendant claims.

We claim:

1. An apparatus for treatment of the person, which comprises a rotatable spindle having mounted thereon a brush means, a fitting carrying the brush means, a structure which is attachable to a wall and incorporates an upwardly extending guiding means for the fitting, a first rotatable, longitudinally extending threaded shaft which cooperates with a female screw fixably attached to said fitting to vertically reciprocate said fitting within the guiding means in response to the clockwise and counterclockwise rotation of said threaded shaft, a second, rotatable, longitudinally extending shaft having a splined outer surface for non-rotational, longitudinal sliding engagement of a transfer means for transferring the rotation of the second longitudinal shaft to the rotatable spindle, and a drive means for simultaneously driving said first and second longitudinally extending shafts.

2. Apparatus according to claim 1 wherein the brush means project from the structure and are rotatable about a horizontal axis; the degree of projection of the structure which is attached to the wall and that of the projecting and rotating part of the brush means being so selected as to make it possible to bring the body into the path of the brush means during its vertical reciprocatory movement.

3. Apparatus according to claim 1, wherein the brush means can be substituted at will by a range of appliances of various types, depending on the need, the fitting which slides in a reciprocating manner being provided with a rotatable spindle for the brush means and a releasable coupling system on the spindle for attaching and detaching a said brush means thereto.

4. Apparatus according to claim 1, wherein the said structure comprises an elongated enclosure and a protective housing which forms a guide for the fitting; the said housing carrying both the means for moving of the fitting and the means for rotating the brush means, the fitting including a rotary spindle body, which latter projects from the protective housing through a longitudinal slot in one wall of the said housing so as to carry externally of the housing a coupling for the brush means.

5. Apparatus according to claim 1, wherein the direction of rotation of the brush means is arranged to be reversed when the vertical reciprocating motion of the fitting carrying the said brush means is reversed.

* * * * *